US011148914B2

(12) United States Patent
Barbet et al.

(10) Patent No.: US 11,148,914 B2
(45) Date of Patent: Oct. 19, 2021

(54) METHOD FOR DEFINING AN OPTIMIZED LOAD CURVE FOR A CRANE, METHOD AND CONTROL DEVICE FOR CONTROLLING THE LOAD SUSPENDED FROM A CRANE ON THE BASIS OF THE OPTIMIZED LOAD CURVE

(71) Applicant: MANITOWOC CRANE GROUP FRANCE, Dardilly (FR)

(72) Inventors: Christophe Barbet, Trevoux (FR); Adrien Gourru, Lyons (FR); Fabrice Thomas, Lyons (FR)

(73) Assignee: MANITOWOC CRANE GROUP FRANCE, Dardilly (FR)

( * ) Notice: Subject to any disclaimer, the term of this patent is extended or adjusted under 35 U.S.C. 154(b) by 567 days.

(21) Appl. No.: 15/572,970

(22) PCT Filed: Jun. 16, 2016

(86) PCT No.: PCT/FR2016/051469

§ 371 (c)(1),
(2) Date: Nov. 9, 2017

(87) PCT Pub. No.: WO2016/203165

PCT Pub. Date: Dec. 22, 2016

(65) Prior Publication Data

US 2018/0155159 A1 Jun. 7, 2018

(30) Foreign Application Priority Data

Jun. 18, 2015 (FR) ..... 15 55585

(51) Int. Cl.
*B66C 23/16* (2006.01)
*B66C 23/90* (2006.01)

(52) U.S. Cl.
CPC ..... *B66C 23/16* (2013.01); *B66C 23/905* (2013.01)

(58) Field of Classification Search
CPC ..... B66C 23/16; B66C 23/905
See application file for complete search history.

(56) References Cited

U.S. PATENT DOCUMENTS 3,638,211 A 1/1972 Sanchez
5,160,055 A * 11/1992 Gray ..... B66C 23/90 212/278

(Continued)

FOREIGN PATENT DOCUMENTS

CN 101786577 A 7/2010
CN 103032185 A 4/2013
EP 1775252 A1 4/2007

OTHER PUBLICATIONS

Rajurkar et al, "Investigation of Stresses in Crane Hook by FEM" International Journal of Engineering Research & Technology (IJERT) vol. 2 Issue 8, Aug. 2013 (Year: 2013).*

(Continued)

*Primary Examiner* — Rehana Perveen
*Assistant Examiner* — Chuen-Meei Gan
(74) *Attorney, Agent, or Firm* — Klintworth & Rozenblat IP LLP

(57) ABSTRACT

This defining method comprises the steps of: —simulating a crane comprising: i) a boom made up of elements and ii) a lifting member that is able to move along the boom, —selecting several elements to be tested, maximum stresses, and several ranges along the boom, and —carrying out the following analysis steps of: •choosing a theoretical load, •calculating stresses brought about by the theoretical load in each element to be tested, •comparing these stresses with maximum stresses, •increasing or decreasing the theoretical load depending on whether stresses are less than or greater (Continued)

than the maximum stresses, •repeating the calculating step and the comparison step and the step of increasing or decreasing until the maximum theoretical load is found, and •recording i) the range and ii) the maximum theoretical load.

12 Claims, 3 Drawing Sheets

(56) References Cited

U.S. PATENT DOCUMENTS

| | | | | |
|---|---|---|---|---|
| 6,496,766 | B1 * | 12/2002 | Bernold | B66C 15/065 212/276 |
| 6,631,300 | B1 * | 10/2003 | Nayfeh | B66C 13/063 212/271 |
| 7,546,928 | B2 * | 6/2009 | Pech | B66C 23/76 212/196 |
| 10,410,124 | B1 * | 9/2019 | Zhou | B66C 23/905 |
| 2002/0144968 | A1 * | 10/2002 | Ruddy | B66D 1/46 212/278 |
| 2005/0098520 | A1 * | 5/2005 | Frankenberger | B66C 23/74 212/276 |
| 2012/0095653 | A1 * | 4/2012 | Morath | B66C 23/905 701/50 |
| 2013/0087522 | A1 | 4/2013 | Jung et al. | |
| 2016/0257534 | A1 * | 9/2016 | Kawai | B66C 23/905 |
| 2018/0179030 | A1 * | 6/2018 | Nysse | B66C 13/16 |

OTHER PUBLICATIONS

Gerdemeli, Ismail, Serpil Kurt, and Okan Deliktas. "Finite element analysis of the tower crane." In 14th International Research/ Expert Conference, Trends in the Development Machinery and Associated Technology TMT. 2010. (Year: 2010).*

Lu, Lulu, Yijui Chiu, Luhmaan Chang, and Chiahao Yang. "The static design and dynamic analysis of the lattice crane truss." In Civil Engineering and Urban Planning 2012, pp. 755-762. 2012. (Year: 2012).*

Karpe, Ajinkya et al., Validation of Use of Fern (Ansys) for Structural Analysis of Tower Crane Jib and Static and Dynamic Analysis of Tower Crane Jib Using Ansys, International Journal of Innovative Research in Advanced Engineering, May 1, 2014, pp. 2349-2163, XP055266676, URL: http://ijirae.com/images/downloads/vol1issue4/MYME10087-13.pdf.

S. Bucas et al., A global procedure for the time-dependent reliability assessment of crane structural members, Engineering Failure Analysis, Jul. 1, 2014, pp. 143-156, XP055266671, vol. 42, ISSN: 1350-6307.

International Search Report issued by ISA/EPO in connection with PCT/FR2016/051469 dated Oct. 6, 2016.

Written Opinion of the ISA issued by ISA/EPO in connection with PCT/FR2016/051469 dated Oct. 6, 2016.

International Preliminary Report on Patentability issued by ISA/EPO in connection with PCT/FR2016/051469 dated Dec. 19, 2017.

* cited by examiner

METHOD FOR DEFINING AN OPTIMIZED LOAD CURVE FOR A CRANE, METHOD AND CONTROL DEVICE FOR CONTROLLING THE LOAD SUSPENDED FROM A CRANE ON THE BASIS OF THE OPTIMIZED LOAD CURVE

CROSS-REFERENCE TO RELATED APPLICATIONS

This is National Stage Application of International Patent Application No. PCT/FR2016/051469, filed Jun. 16, 2016, which claims priority to French Patent Application No. 15/55585, filed on Jun. 18, 2015, both which are incorporated herein by reference in their entireties.

FIELD

The present invention concerns a definition method for defining a load curve for a crane. Furthermore, the present invention concerns a method and a monitoring device for monitoring the load suspended from a crane.

The present invention applies to the field of the cranes with jibs. The present invention may be applied to several types of cranes, for example to the distributing cranes, the luffing cranes and self-erecting cranes, these cranes having or not guy lines.

BACKGROUND

In the state of the art, a load curve is defined from a theoretical load lifted to the maximum reach of the jib. From this theoretical load, a maximum load moment is deduced. Then, for each reach smaller than the maximum reach, the theoretical load is calculated so as to keep this maximum load moment. Thus, each element of the structure is loaded by a constant maximum load moment when the jib lifts loads with different reaches.

However, such a definition method defines a load curve which limits sometimes excessively the use of the jib at some reaches, because the structural boundary is determined only by the maximum load with the largest reach.

SUMMARY

The present invention aims in particular to solve, in whole or part, the aforementioned problems.

To this end, the object of the present invention is a definition method, for defining a load curve for a crane, the definition method comprising the steps:

simulating a crane comprising at least:

i) a jib comprising a structure composed of several elements, and ii) a lifting member which is configured to lift a load and which is movable along the jib successively in several reaches, selecting several elements to be tested, for each element to be tested, selecting at least one respective maximum predetermined stress, selecting several reaches along the jib, and at each reach, carrying out the following analysis steps:

choosing a theoretical load to be suspended from the lifting member, calculating stresses which are induced by the theoretical load in each element to be tested, for each element to be tested, comparing the calculated stresses with the respective predetermined maximum stresses, incrementing the theoretical load if at least one of the calculated stresses is less than a respective predetermined maximum stress, decrementing the theoretical load if at least one of the calculated stresses is greater than a respective predetermined maximum stress, repeating i) the calculation step and ii) the comparison step and one from iii) the incrementation step and iii) the decrementation step until finding the maximum theoretical load for which the calculated stresses are substantially equal to the respective predetermined maximum stresses, and storing in a memory a group of values comprising i) the reach and ii) the maximum theoretical load for which the calculated stresses are substantially equal to the respective predetermined maximum stresses.

Thus, such a definition method allows defining an optimized load curve in each selected reach, that is to say a «point-to-point» optimized load curve. Thus, such a definition method allows using the jib to the maximum of its capacities regardless of the reach at which the load is lifted. Indeed, this definition method allows using the jib with a load inducing a predetermined maximum stress on at least one element of the structure. In other words, at least one element of the structure is used to the maximum of its capacity.

Such a definition method allows defining an optimized load curve for an existing crane. Such a definition method also allows sizing a jib during the design of the jib, that is to say selecting the sizes of several elements of the structure of the jib before manufacturing this jib. The definition method is then part of a sizing method.

In the present application, the term «stress» means a mechanical stress, that is to say a force exerted on a surface. In the present application, the term «calculated stress» means the stress calculated for a theoretical load considered as suspended from the lifting member (simulation).

A stress may be calculated in accordance with a standard and/or a directive which applies to the area where the crane should come into operation. For example, the machine directive CE-89/392, the standard FEM.1.001 and the standard EN14439 apply in Europe.

The predetermined maximum stresses may be imposed by a standard and/or by an applicable directive. In general, a standard or a directive imposes permissible stresses not to exceed, by applying, where appropriate, a safety coefficient to the yield strength of the considered material.

Alternatively, the predetermined maximum stresses may be set by the designer of the crane or by the user of the crane more strictly than with the applicable standard or directive.

Moreover, the predetermined maximum stresses may be calculated not to exceed maximum stresses in static loading and/or not to exceed maximum stress magnitudes required for the fatigue analyzes.

After finding the theoretical load for each selected reach, a definition step consists in defining a load curve indicating the theoretical loads found as a function of the selected reaches. Thus, an optimum load curve may be defined by taking into account all or almost all the elements of the structure.

According to a variant, the simulation step implements computer-assisted drawing software to design the jib.

According to a variant, the load curve may include the mass of the carriage, the mass of the hook, the mass of the block, the mass of the cable and the mass of the actuator configured to drive the cable and/or the carriage. Thus, the load curve directly indicates the payload that the jib can lift.

According to an embodiment, the structure comprises a lattice, the elements comprising bars arranged to form the lattice.

Alternatively or complementarily to this embodiment, the structure may comprise a box, said elements comprising plates arranged to form the box. Each plate forms a structural element, that is to say, an element of the structure. The box may be formed of several segments assembled together so as to compose the jib.

According to a variant, during the selection step of several elements to be tested, a portion of the elements is selected. In other words, several elements but not all the elements of the structure are selected. Then, the analysis steps are carried out on the elements to be tested which have been selected. Thus, such a selection step limits the number of calculations to be made during the analysis steps. For example, 80% or 90% of the bars forming the lattice of a jib may be selected.

Alternatively to this variant, all the elements of the structure may be selected. For example, 100% of the bars forming the lattice of a jib may be selected.

According to an embodiment, during the selection step of several reaches, the reaches are selected in a regular distribution along the jib. Thus, such a regular distribution of the reaches allows defining an optimized load curve all along length of the jib.

According to an embodiment, the reaches are spaced apart in pairs, by an interval comprised between 0.5% and 10%, preferably between 1% and 2%, of the length of the jib.

Thus, such an interval between reaches allows defining an optimized load curve all along the jib, while limiting the number of calculations required for defining a load curve.

Alternatively to the two preceding embodiments, the reaches may be selected in an irregular distribution along the jib. For example, for a set of small reaches, the interval between two small reaches may be relatively large, while for a set of large reaches, the interval between two large reaches may be relatively small. Thus, the number of analysis steps required to define a load curve is reduced.

According to a variant, the definition method further comprises an interpolation step, in which the theoretical loads found for the different reaches are interpolated so as to define the load curve. Thus, such an interpolation step allows limiting the number of required calculations to define a load curve.

According to an embodiment, during the calculation step of the calculated stresses, calculated stresses are calculated for a stressing mode selected from the group constituted of traction, shear, compression, buckling, torsion and bending.

Thus, these calculated stresses allow using the jib at the maximum of its capacities for at least one stressing mode.

The predetermined maximum stresses may arise from different stressing modes, for example a traction mode, a shear mode, a compression mode including a buckling mode, a bending mode, a torsion mode, or still a combined mode of at least two of these different stressing modes.

Thus, these calculated stresses allow using the jib at the maximum of its capacities for several stressing modes.

For example, calculated stresses may be calculated for all these stressing modes: traction, shear, compression, buckling, torsion and/or bending. In this variant, several predetermined maximum stresses corresponding to the selected stressing modes.

According to an embodiment, during the selection step of the predetermined maximum stresses, each predetermined maximum stress is selected so as to be comprised between 90% and 100% of a respective permissible stress.

In other words, each predetermined maximum stress is selected so as to reach, for each element, a utilization rate comprised between 90% and 100%.

In the present application, the term «utilization rate» means the ration of a stress applied to an element to the permissible stress for this element, which is for example imposed by a standard or directive. Thus, such predetermined maximum stresses are close to the permissible stresses. Therefore, the jib may be used practically to the maximum of the permissible stresses.

According to an embodiment, the analysis steps are carried out initially for the largest selected reach, so as to firstly find the theoretical load for the largest selected reach.

Then, during the selection step of a theoretical load for each other selected reach, the theoretical load is chosen inducing, around one end of the jib opposite to the largest reach, a moment equal to the moment induced by the theoretical load found for the largest selected reach.

Thus, these analysis steps and this choice step allow minimizing the number of required calculations. In general, the largest reach is selected approximately equal to the length of the jib.

Moreover, the object of the present invention is a monitoring method, for monitoring the load suspended from a crane, the monitoring method comprising the steps:

providing a crane comprising at least:

i) a jib, ii) a lifting member which is configured to lift a load and which is movable along the jib successively in several reaches, iii) an evaluation device configured to evaluate magnitude representative of the load suspended from the lifting member, and iv) a measuring device configured to measure a magnitude representative of the instantaneous reach, providing a monitoring device comprising a memory containing the load curve defined by a definition method according to the invention, evaluating, by means of the evaluation device, a magnitude representative of the load suspended from the lifting member, measuring, by means of the measuring device, a magnitude representative of the instantaneous reach, communicating to the monitoring device control signals intended to control at least one movement of the lifting member from: i) a lifting movement to lift a target load; and ii) a distribution movement to displace the lifting member to a target reach, comparing the target load with the theoretical load indicated for the target reach by the load curve, and if the target load is greater than said theoretical load indicated for the target reach, restricting said at least one movement of the lifting member.

Thus, such a monitoring method may allow for improved stability of the crane.

According to an embodiment, the restriction step comprises: i) a preventing step in which said at least one movement of the lifting member is prevented, and ii) a warning step in which the monitoring device communicates an exceeding warning notifying that the target load is excessive for the target reach.

Thus, such a restriction step allows stopping any movement of the suspended load in case where the monitoring device anticipates an exceeding of the load curve.

Alternatively to the preceding embodiment, the restriction step may comprise: i) a limiting step in which the lifting member is displaced to a reach smaller than the target reach. Thus, in case where the monitoring device anticipates an exceeding of the load curve, such a limiting step allows authorizing only partially a movement of the suspended load to the extent allowed by the load curve.

According to an embodiment, the evaluation device comprises at least one measuring member selected from the group consisting of an electronic encoder and a displacement potentiometer.

Thus, such a measuring device allows accurately measuring the instantaneous reach.

Furthermore, the object of the present invention is a monitoring device comprising:

- a memory containing the load curve defined by a definition method according to the invention, and
- a calculation unit configured to carry out a monitoring method according to the invention.

Thus, such a monitoring device may allow for improved stability of the crane.

According to a variant, the monitoring device may belong to the crane. For example, the monitoring device may be integrated into a control system of the crane, which may be installed in a control cabin of the crane. The object of the present invention is also a crane comprising a control system, the control system integrating such a monitoring device.

Alternatively to this variant, the monitoring device may be distant from the crane. For example, the monitoring device may be integrated into a remote control configured to control the crane from the ground.

Moreover, the object of the present invention is a crane comprising such a monitoring device.

The aforementioned embodiments and variants may be considered alone or in any technically possible combination.

BRIEF DESCRIPTION OF THE DRAWINGS

The present invention will be well understood and its advantages will also emerge in the light of the following description, given only by way of non-limiting example and with reference to the appended figures, in which identical reference signs correspond to structurally and/or functionally identical or similar objects. In the appended figures.

DESCRIPTION

Figure 1:
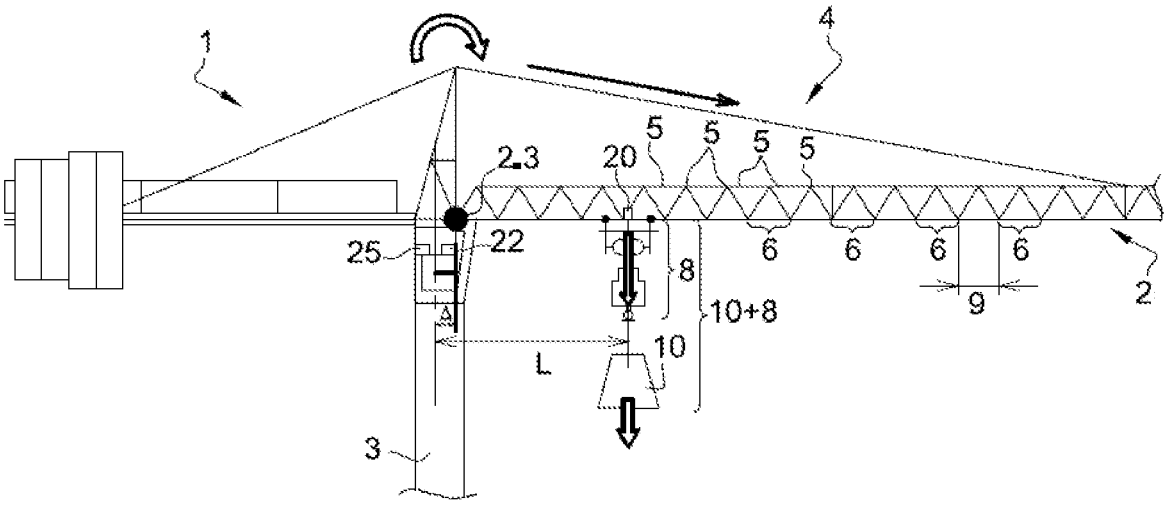
FIG. 1 is a schematic view illustrating a portion of a crane comprising a monitoring device implementing a monitoring method in accordance with the invention, from a load curve defined according to a definition method in accordance with the invention.

FIG. 1 illustrates a crane 1 comprising a jib 2 and a tower 3 which supports the jib 2. The jib 2 is hinged relative to the tower 3 in particular about an axis 2.3. The jib 2 comprises a structure 4. The structure 4 is composed of several elements 5. Each element 5 forms a structural element, that is to say an element of the structure 4.

In the example of FIG. 1, the structure 4 comprises a lattice and the elements 5 comprise bars arranged to form this lattice. Each element 5 is here a segment of the structure 4 including several bars.

The crane 1 further comprises a lifting member 8. The lifting member 8 is configured to lift a load 10. As shown in FIG. 1, the lifting member 8 here comprises a carriage, a hook, a block, a cable and an actuator configured to drive the cable and the carriage.

Thanks to the actuator and the carriage, the lifting member 8 is movable along the jib 2 successively in several reaches L. The lifting member 8 is at the minimum reach when it is located as closest as possible to the tower 3. The lifting member 8 is at the maximum reach when it is located the farthest away from the tower 3.

Figure 2:
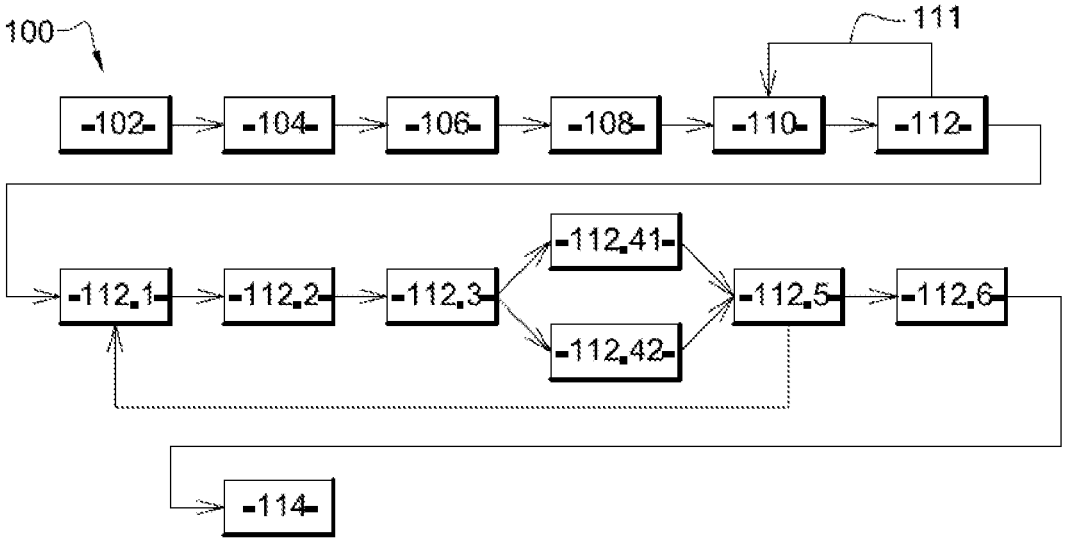
FIG. 2 is a flow chart illustrating a definition method in accordance with the invention.

FIG. 2 illustrates a definition method 100 for defining a load curve for a crane 1. The definition method 100 comprises a simulation step 102, in which the crane 1 comprising the lifting member 8 and the jib 2 is simulated. The simulation step 102 may implement a computer-assisted drawing software in order to design the jib 2. In this simulation step, the structure 4 is broken down into several elements 5. This simulation step 102 may further be operated by means of a computer, not shown, which is equipped with a program designed for perform analytical calculations.

The definition method 100 further comprises a selection step 104 of elements to be tested 6, in which several elements to be tested 6 are selected from the elements 5. In the example of FIG. 2, most of the elements 5 of the structure 4 are selected as elements to be tested 6. Here, 90% of the bars forming the lattice of the jib 2 may be selected. This step of selecting elements to be tested 6 may be operated by means of the computer.

Furthermore, the definition method 100 comprises a selection step 108 of stresses, in which, for each element to be tested 6, predetermined maximum stresses are selected so as to define in a set of predetermined maximum stresses. For a crane 1 intended to serve in Europe, the maximum predetermined stresses may be selected at 90% of the permissible stresses imposed by the machine directive EC-89/392, the FEM.1.001 standard and the EN14439 standard.

This selection step 108 of stresses may be operated by means of the computer, such that the set of predetermined maximum stresses may be stored in this computer. The predetermined maximum stresses may be selected so as to reach, for each element 5, a utilization rate of about 90%.

The definition method 100 further comprises a step of selecting reaches L, in which several reaches L are selected along the jib 2. During this selection step 110 of several reaches L, the reaches L are selected in a regular distribution along the jib 2. The selected reaches L are spaced apart in pairs, by an interval 9 approximately equal to 1.5% of the length of the jib 2, here about 1 m. This selection step 110 of reaches may be operated by means of the computer.

Then, in the definition method 100, at each reach L selected in step 110; the analysis steps 112 described below are carried out. The analysis steps 112 may be operated by means of the computer.

To start, the analysis steps 112 are operated for a first reach L, for example for the largest selected reach (for example the maximum reach) along the jib 2. The analysis steps 112 comprise:

a choice step 112.1, in which a theoretical load to be suspended from the lifting member 8 is chosen; this theoretical load is chosen arbitrarily, a calculation step 112.2, in which stresses which are induced by the theoretical load in each element to be tested 6 are calculated, here for several stressing modes among the traction, the shear, the compression, the buckling, the torsion and the bending; and a comparison step 112.3, in which for each element to be tested 6, the calculated stresses are compared with respective predetermined maximum stresses.

Then, the analysis steps 112 comprise:

either an incrementation step 112.41, in which if at least one of the calculated stresses is less than a respective predetermined maximum stress, the theoretical load is incremented;

or a decrementation step 112.42, in which, if at least one of the calculated stresses is greater than a respective predetermined maximum stress, the theoretical load is decremented.

Then, the analysis steps 112 comprise an iteration step 12.5, in which we repeat:

i) the calculation step (112.2) and ii) the comparison step (112.3) and either iii) the incrementation step (112.41)

or iii) the decrementation step (112.42)

until finding the maximum theoretical load for which the calculated stresses are substantially equal to the respective predetermined maximum stresses.

The number of iteration steps 112.5 depends on the theoretical load chosen during the choice step 112.1 and on the increment of the theoretical load. A small increment will require more iteration steps 112.5 than a large increment, but a small increment will result in a defined theoretical load with more accuracy than a large increment.

In order to minimize the number of required calculations, during the choice step 112.1 a theoretical load for each other reach, it is possible to choose the theoretical load inducing, around one end of the jib 2 opposite to the largest reach, a moment equal to the moment induced by the theoretical load found for the largest selected reach.

After finding the maximum theoretical load for the reach L, the definition method 100 comprises a storing step 112.6, in which a group of values comprising i) the reach L and ii) the maximum theoretical load for which the calculated stresses are substantially equal to the respective predetermined maximum stresses is stored in a memory of the computer. Thus, a maximum theoretical load is associated to each reach L in the memory.

Then, as indicated by the jib 111 in FIG. 2, the reach L is changed, then the analysis steps 112 are carried out again for the next reach, and so on for all the selected reaches L during the selection step 110.

After carrying out the analysis steps 112 for all the selected reaches L, a set which contains the groups of values {reach L; maximum theoretical load} is obtained. This set of values allows defining an optimized load curve 50, shown in FIG. 5. Thus, after finding the theoretical load for each selected reach L, a definition step 114 consists in defining the load curve 50 indicating:

on the ordinate axis: the payloads 10+8 (in metric tons), deducted from the found theoretical loads, on the abscissa axis: the reaches L (in meters).

The payload 10+8 is here the sum of the found theoretical load and the mass of the lifting member 8 (carriage, hook, block, cable and actuator).

Figure 5:
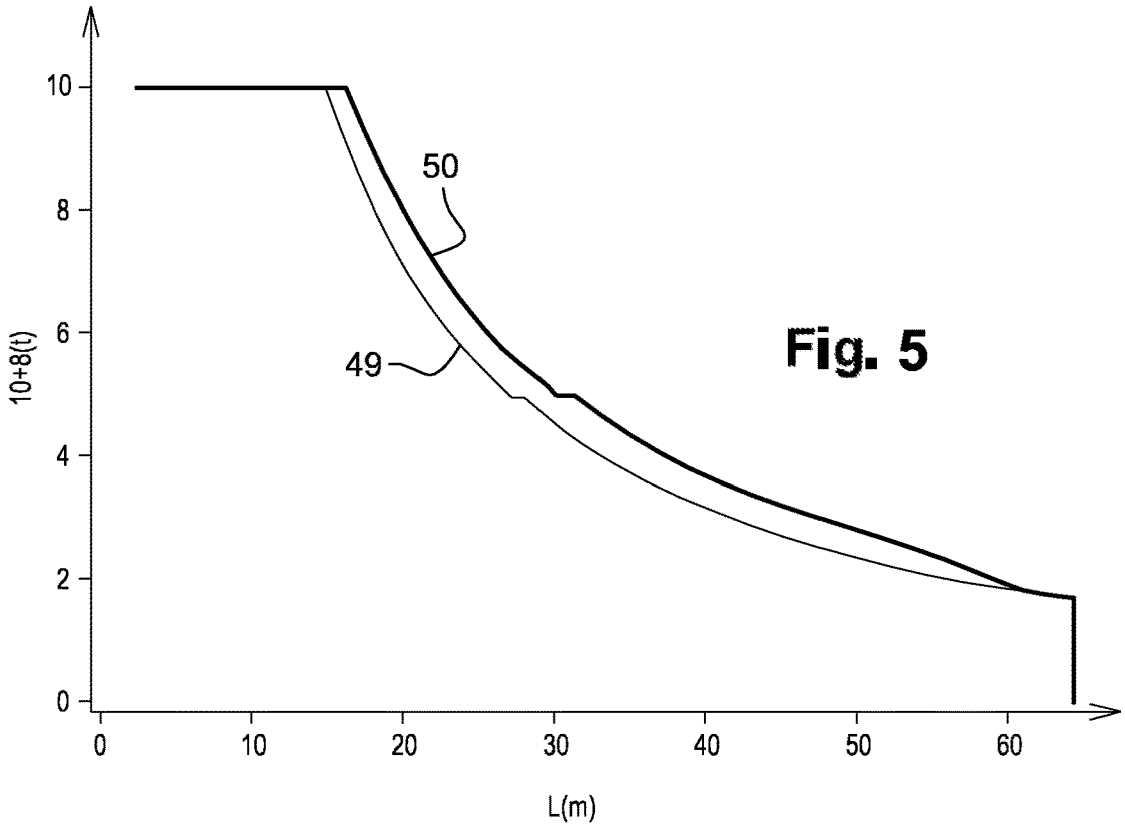
FIG. 5 is a diagram showing a load curve defined according to the definition method of FIG. 2.
Figure 6:
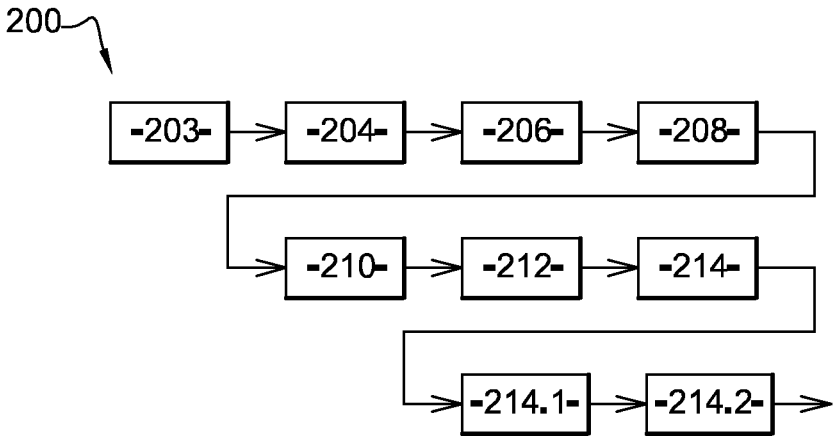
FIG. 6 is a view of a monitoring method in accordance with the invention.

For comparison, FIG. 5 illustrates a load curve 49 which has been obtained by a method of the state of the art while keeping the maximum load moment constant. The load curve 50 obtained by the definition method 100 in accordance with the invention is optimized relative to the load curve 49 of the state of the art. Indeed, the load curve 50 allows lifting heavier payloads at all the reaches L.

Figure 3:
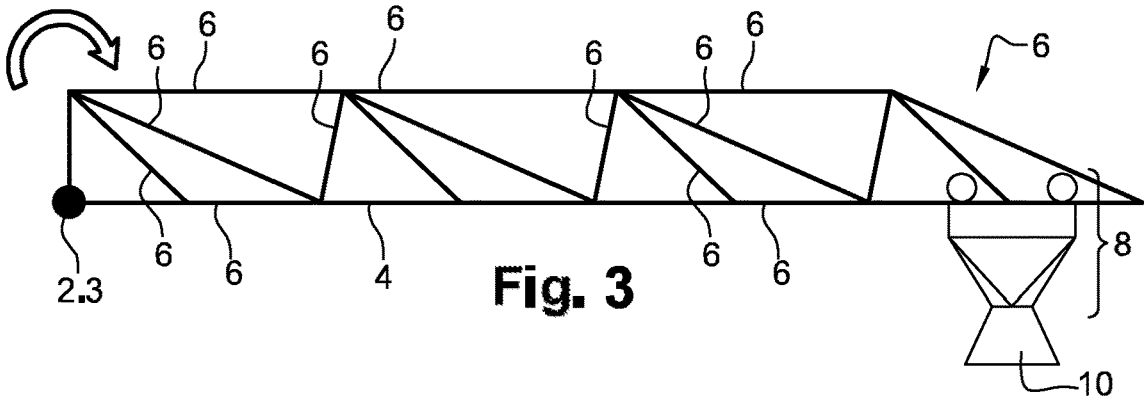
FIGS. 3 and 4 are schematic views illustrating the jib of FIG. 1 respectively during the two steps of the definition method of FIG. 2.
Figure 4:
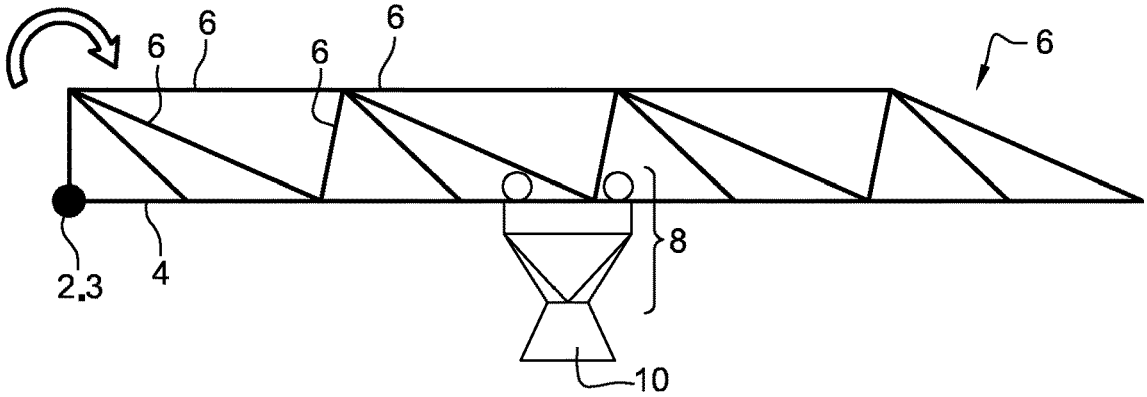

Moreover, FIG. 3 illustrates a monitoring method 200, for monitoring the load suspended from the crane 1. The monitoring method 200 comprises a provision step 202, in which the crane 1 is provided, comprising:

i) the jib 2, ii) the lifting member 8, iii) an evaluation device 20 which is configured to evaluate the mass of the load 10 suspended from the lifting member 8; the evaluation device 20 here comprises an electronic encoder, and iv) a measuring device 22 which is configured to measure the length of the instantaneous reach L.

Figure 7:
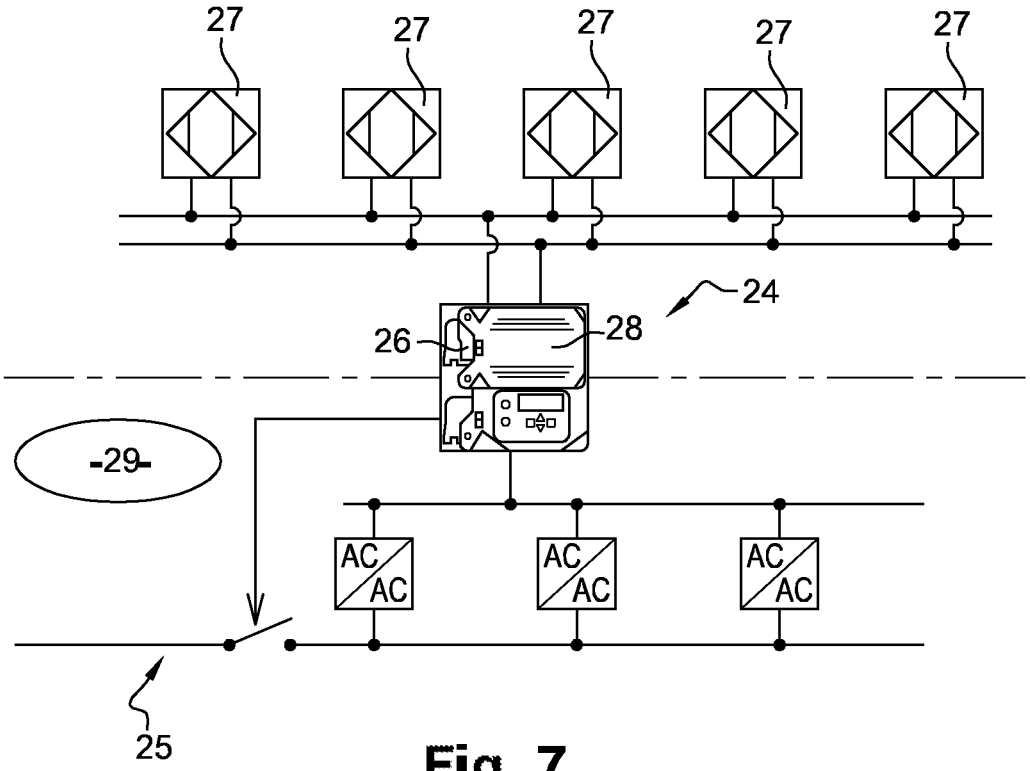
FIG. 7 is a view of a monitoring device in accordance with the invention and configured to implement the monitoring method of FIG. 6.

The monitoring method 200 further comprises a provision step 204, in which a monitoring device 24 is provided, shown in FIG. 7, comprising a memory 26 which contains the load curve 50 defined according to the definition method 100.

As shown in FIG. 7, the monitoring device 24 further comprises a calculation unit 28 which is configured to carry out the monitoring method 200. In the example of the figures, the monitoring device 24 is integrated in a control system 25 installed on the crane 1.

The control system 25 further comprises a stop control 29 and position sensors 27 which are configured to generate signals representative of the position of the carriage, the angular position of the jib 2 relative to the tower 3, the position of the hook, the position of the block and the position of the load 10, respectively.

The monitoring method 200 further comprises the following steps:

206: evaluating, by means of the evaluation device 20, the mass of the load 10 suspended from the lifting member 8,

208: measuring, by means of the measuring device 22, the length of the instantaneous reach L,

210: communicating to the monitoring device 24 control signals intended to control at least one movement of the lifting member 8 from: i) a lifting movement to lift a target load; and ii) a distribution movement to displace the lifting member (8) to a target reach,

212: comparing the target load with the theoretical load indicated for the target reach by the load curve 50, and

214: if the target load is greater than said theoretical load indicated for the target reach, restricting the movement of the lifting member 8.

In particular, the restriction step 214 comprises: i) a preventing step 214.1 in which said at least one movement of the lifting member 8 is prevented, and ii) a warning step 214.2 in which the monitoring device 24 communicates an exceeding warning notifying that the target load is excessive for the target reach.

Of course, the present invention is not limited to the particular embodiments described in the present patent application, or to embodiments which are within the reach of those skilled in the art. Other embodiments may be envisaged without departing from the scope of the invention, starting from any element equivalent to an element indicated in the present patent application.

The invention claimed is:

1. A controlling method, for controlling a lifting member of a crane, the controlling method comprising the following steps:

providing a physical crane comprising a jib comprising a structure composed of several elements, and a lifting member configured to lift a load and is movable along the jib successively in several reaches;

simulating, by a computer, the crane comprising at least:

i) the jib comprising the structure composed of several elements, and ii) the lifting member which is configured to lift the load and which is movable along the jib successively in several reaches, a first selection step comprising selecting several elements to be tested, a second selection step comprising, for each element to be tested, selecting at least one respective predetermined maximum stress, a third selection step comprising selecting several reaches along the jib, and at each reach, carrying out the following analysis steps:

a choice step comprising choosing a theoretical load to be suspended from the lifting member, a calculation step comprising calculating stresses which are induced by the theoretical load in each element to be tested, a comparison step comprising, for each element to be tested, comparing the calculated stresses with the respective predetermined maximum stresses, an incrementation step comprising incrementing the theoretical load if at least one of the calculated stresses is less than a respective predetermined maximum stress, a decrementation step comprising decrementing the theoretical load if at least one of the calculated stresses is greater than a respective predetermined maximum stress, repeating i) the calculation step and ii) the comparison step and one from iii) the incrementation step and iii) the decrementation step until finding the maximum theoretical load for which the calculated stresses are substantially equal to the respective predetermined maximum stresses, storing in a memory a group of values comprising i) the reach and ii) the maximum theoretical load for which the calculated stresses are substantially equal to the respective predetermined maximum stresses, and defining a load curve for the crane, the load curve indicating the maximum theoretical loads found as a function of the selected reaches, communicating to a monitoring device control signals to control at least one movement of the lifting member of the physical crane from: i) a lifting movement to lift a target load; and ii) a distribution movement to displace the lifting member to a target reach based on the target reach indicated by the load curve.

2. The controlling method according to claim 1, wherein the structure comprises a lattice, the elements comprising bars arranged to form the lattice.

3. The controlling method according to claim 1, wherein, during the third selection step comprising in selecting several reaches, the reaches are selected in a regular distribution along the jib.

4. The controlling method according to claim 3, wherein the reaches are spaced apart in pairs, by an interval comprised between 0.5% and 10% of the length of the jib.

5. The controlling method according to claim 4, wherein the reaches are spaced apart in pairs, by an interval comprised between 1% and 2% of the length of the jib.

6. The controlling method according to claim 1, wherein, during the calculation step comprising calculating stresses, said stresses are calculated for a stressing mode selected in the group constituted of traction, shear, compression, buckling, torsion and bending.

7. The controlling method according to claim 1, wherein, during the second selection step comprising selecting predetermined maximum stresses, each predetermined maximum stress is selected so as to be comprised between 90% and 100% of a respective permissible stress.

8. The controlling method according to claim 1, wherein the analysis steps are initially carried out for a largest selected reach, so as to find firstly the theoretical load for the largest selected reach, then in which, during the choice step comprising in choosing a theoretical load for each other selected reach, the theoretical load is chosen inducing, around one end of the jib opposite to the largest reach, a moment equal to the moment induced by the theoretical load found for the largest selected reach.

9. A monitoring method for monitoring a load suspended from a crane, the monitoring method comprising the steps of:

providing a physical crane comprising at least:

i) a jib, ii) a lifting member which is configured to lift a load and which is movable along the jib successively in several reaches, iii) an evaluation device configured to evaluate a magnitude representative of the load suspended from the lifting member, and iv) a measuring device configured to measure a magnitude representative of the instantaneous reach, providing a monitoring device comprising a memory containing a load curve defined by a definition method, comprising the following steps:

simulating, by a computer, the crane comprising at least:

i) the jib comprising the structure composed of several elements, and ii) the lifting member which is configured to lift the load and which is movable along the jib successively in several reaches, a first selection step comprising selecting several elements to be tested, a second selection step comprising, for each element to be tested, selecting at least one respective predetermined maximum stress, a third selection step comprising selecting several reaches along the jib, and at each reach, carrying out the following analysis steps:

a choice step comprising choosing a theoretical load to be suspended from the lifting member, a calculation step comprising calculating stresses which are induced by the theoretical load in each element to be tested, a comparison step comprising, for each element to be tested, comparing the calculated stresses with the respective predetermined maximum stresses, an incrementation step comprising incrementing the theoretical load if at least one of the calculated stresses is less than a respective predetermined maximum stress, a decrementation step comprising decrementing the theoretical load if at least one of the calculated stresses is greater than a respective predetermined maximum stress, repeating i) the calculation step and ii) the comparison step and one from iii) the incrementation step and iii) the decrementation step until finding the maximum theoretical load for which the calculated stresses are substantially equal to the respective predetermined maximum stresses, storing in a memory a group of values comprising i) the reach and ii) the maximum theoretical load for which the calculated stresses are substantially equal to the respective predetermined maximum stresses, and defining the load curve for the crane, the load curve indicating the maximum theoretical loads found as a function of the selected reaches, evaluating, by means of the evaluation device, magnitude representative of the load suspended from the lifting member of the physical crane, measuring, by means of the measuring device, magnitude representative of the instantaneous reach, communicating to the monitoring device control signals intended to control at least one movement of the lifting member of the physical crane from: i) a lifting movement to lift a target load; and ii) a distribution movement to displace the lifting member to a target reach, comparing the target load with the theoretical load indicated for the target reach by the load curve, and a restriction step comprising in, if the target load is greater than said theoretical load indicated for the target reach, restricting said at least one movement of the lifting member of the physical crane.

10. The monitoring method according to claim 9, wherein the restriction step comprises: i) a preventing step in which said at least one movement of the lifting member is prevented, and ii) a warning step in which the monitoring device communicates an exceeding warning notifying that the target load is excessive for the target reach.

11. The monitoring method according to claim 9, wherein the evaluation device comprises at least one measuring member selected from the group constituted of an electronic encoder and a displacement potentiometer.

12. A monitoring device comprising:

a memory containing a load curve defined by a definition method for defining the load curve, the method comprising the following steps:

simulating a crane comprising at least:

i) a jib comprising a structure composed of several elements, and ii) a lifting member which is configured to lift a load and which is movable along the jib successively in several reaches, a first selection step comprising selecting several elements to be tested, a second selection step comprising, for each element to be tested, selecting at least one respective predetermined maximum stress, a third selection step comprising selecting several reaches along the jib, and at each reach, carrying out the following analysis steps:

a choice step comprising choosing a theoretical load to be suspended from the lifting member, a calculation step comprising calculating stresses which are induced by the theoretical load in each element to be tested, a comparison step comprising, for each element to be tested, comparing the calculated stresses with the respective predetermined maximum stresses, an incrementation step comprising incrementing the theoretical load if at least one of the calculated stresses is less than a respective predetermined maximum stress, a decrementation step comprising decrementing the theoretical load if at least one of the calculated stresses is greater than a respective predetermined maximum stress, repeating i) the calculation step and ii) the comparison step and one from the incrementation step and iv) the decrementation step until finding the maximum theoretical load for which the calculated stresses are substantially equal to the respective predetermined maximum stresses, defining the load curve for the crane, the load curve indicating the maximum theoretical loads found as a function of the selected reaches, storing in a memory a group of values comprising i) the reach and ii) the maximum theoretical load for which the calculated stresses are substantially equal to the respective predetermined maximum stresses, and a physical crane comprising at least:

i) a jib, ii) a lifting member which is configured to lift a load and which is movable along the jib successively in several reaches, iii) an evaluation device configured to evaluate a magnitude representative of the load suspended from the lifting member, and iv) a measuring device configured to measure a magnitude representative of the instantaneous reach, a calculation unit configured to carry out a monitoring method for monitoring a load suspended from a physical crane, the monitoring method comprising the steps of:

evaluating, by means of the evaluation device, magnitude representative of the load suspended from the lifting member, measuring, by means of the measuring device, magnitude representative of the instantaneous reach, communicating to the monitoring device control signals intended to control at least one movement of the lifting member from: i) a lifting movement to lift a target load; and ii) a distribution movement to displace the lifting member to a target reach, comparing the target load with the theoretical load indicated for the target reach by the load curve, and a restriction step comprising, if the target load is greater than said theoretical load indicated for the target reach, restricting said at least one movement of the lifting member.

* * * * *